US006867737B1

(12) United States Patent
Ryken, Jr. et al.

(10) Patent No.: US 6,867,737 B1
(45) Date of Patent: Mar. 15, 2005

(54) REDUCED SIZE GPS CONICAL SHAPED MICROSTRIP ANTENNA ARRAY

(75) Inventors: Marvin L. Ryken, Jr., Oxnard, CA (US); Albert F. Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 23 days.

(21) Appl. No.: 10/648,715

(22) Filed: Aug. 27, 2003

(51) Int. Cl.[7] ..... H01Q 1/36
(52) U.S. Cl. ..... 343/700 MS
(58) Field of Search ..... 343/700 MS, 705, 343/708, 815, 829, 846, 853

(56) References Cited

U.S. PATENT DOCUMENTS 5,019,829 A * 5/1991 Heckman et al. .... 343/700 MS
6,011,518 A * 1/2000 Yamagishi et al. ..... 343/713
6,466,172 B1 * 10/2002 Ryken et al. ..... 343/700 MS
6,549,168 B1 * 4/2003 Ryken et al. ..... 343/700 MS

* cited by examiner

*Primary Examiner*—Don Wong
*Assistant Examiner*—Huedung X. Cao
(74) *Attorney, Agent, or Firm*—David S. Kalmbaugh

(57) ABSTRACT

A GPS conical shaped microstrip antenna array which receives GPS data and which is adapted for use on weapons systems such as a missile or smart bomb. The microstrip antenna array has a center frequency of 1.575 GHz, a frequency bandwidth of twenty megahertz and provides for right hand circular polarization. The microstrip antenna includes a four aligned copper antenna elements which have a square shape, and a copper etched feed network which provides for a signal phase shift of ninety degrees resulting in right hand circular polarization of each of the four aligned antenna elements.

21 Claims, 4 Drawing Sheets

REDUCED SIZE GPS CONICAL SHAPED MICROSTRIP ANTENNA ARRAY

BACKGROUND OF THE INVENTION

1. Field of the Invention

The present invention relates generally to a microstrip antenna for use on a weapons system to receive externally generated data. More specifically, the present invention relates to a reduced size GPS conical shaped microstrip antenna array which receives GPS data and which is adapted for use in a small area on a weapons system such as a missile.

2. Description of the Prior Art

There is currently a need for a miniature microstrip antenna array which receives GPS (Global Positioning System) data for use in a confined area within a small diameter weapons system such as a missile, a artillery shell, smart bomb or the like. The microstrip antenna array needs to operate at the GPS L1 Band centered at a frequency of 1.575 GHz, have a bandwidth of twenty megahertz and right hand circular polarization. The shape of the microstrip antenna array should ideally be conical.

A microstrip antenna array has a unique problem in that the feed line for each antenna element becomes effectively connected to the antenna element as the feed line is positioned closer to the element. The feed line no longer distributes antenna power to the antenna elements in phase and amplitude due to coupling between the antenna elements and the feed line.

In the past microstrip antenna arrays have been designed with considerable separation between the feed line and the antenna elements so that coupling was not a concern to the antenna designer. When less space was available, multiple dielectric layers were used for the antenna and the feed line was placed on a lower dielectric layer within the antenna. This allows the feed line to be made smaller with a resulting reduced spacing to the antenna elements.

However, there is still a need to minimize the interaction between the feed line for the antenna and the microstrip antenna elements of the antenna when the antenna is confined to a very small area and the designer needs to place the feed on the same dielectric layer as the antenna elements of the antenna.

SUMMARY OF THE INVENTION

The present invention overcomes some of the difficulties of the past in that comprises a highly efficient microstrip antenna having array of antenna elements which require considerably less space than other microstrip antenna arrays designed for use in confined spaces within a weapons system such as a missile, a smart bomb or the like.

The present invention comprises a GPS conical shaped microstrip antenna array which receives GPS data and which is adapted for use in a confined space on weapons systems such as a missile or smart bomb. The microstrip antenna array has a center frequency of 1.575 GHz, a frequency bandwidth of twenty megahertz and provides for right hand circular polarization. The microstrip antenna includes four aligned copper antenna elements which have a square shape, and a copper etched feed network which provides for a signal phase shift of ninety degrees resulting in right hand circular polarization of each of the four aligned antenna elements.

The microstrip antenna includes three dielectric layers with the top dielectric layer comprising the cover board, the middle dielectric layer comprising the circuit board including the four antenna elements, and the bottom dielectric layer comprising the ground board.

The upper surface of the circuit board includes the four copper antenna elements and an etched copper cross hatch pattern which is positioned around each of the antenna elements. The bottom surface also has an etched copper cross hatch pattern and a feed network for the antenna elements. The upper surface of the ground board has an etched copper cross hatch pattern which is in alignment with the cross hatch pattern of the bottom surface of the circuit board. The bottom surface of the ground board has a copper ground plane affixed thereto.

Since the layout of the bottom surface of the circuit board is virtually identical to the layout of the upper surface of ground board, microwave signals will EM couple between dielectric layers even though there is bonding film which separates the circuit board from the ground board. This unique feature of the mirostrip antenna array allows the vias on the circuit board to EM couple to the vias on the ground board thereby providing an electrical connection for the circuit board to the copper ground plane on the bottom surface of ground board.

DETAILED DESCRIPTION OF A PREFERRED EMBODIMENT

Figure 1:
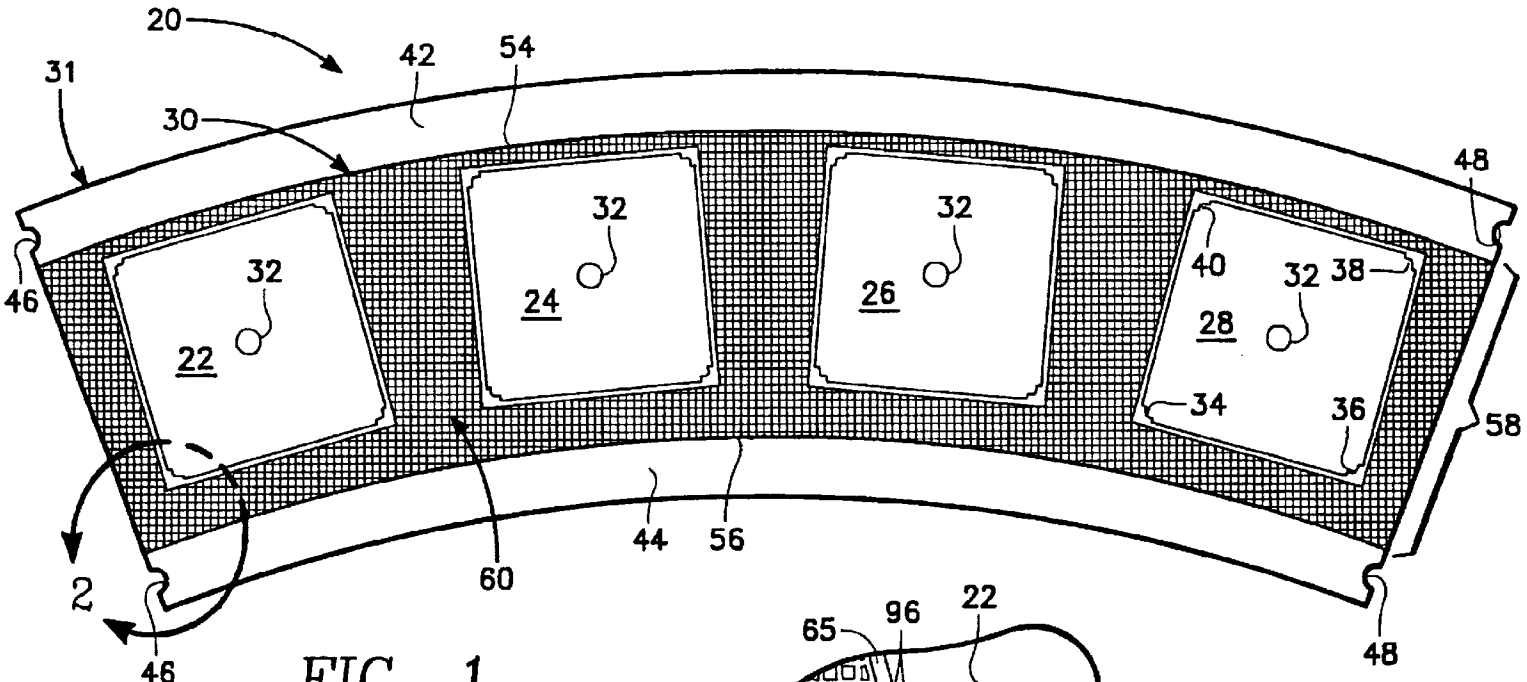
FIG. 1 illustrates the top copper layer of a circuit board which includes the antenna elements for the reduced size GPS conical shaped microstrip antenna comprising the present invention.
Figure 2:
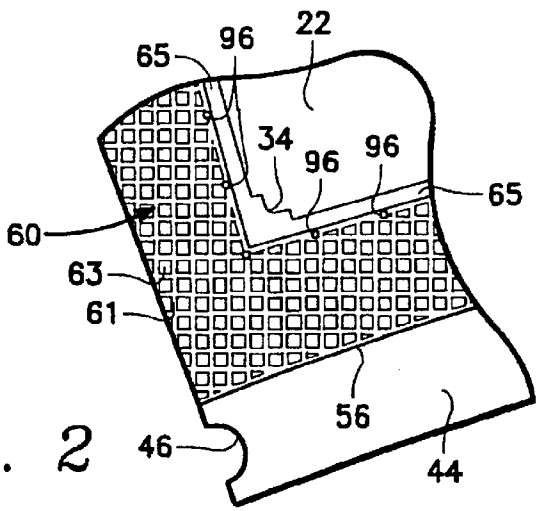
FIG. 2 is a exploded view taken along line 2—2 of FIG. 1 illustrating the tuning tabs and copper cross hatch pattern for the circuit board of FIG. 1.

Referring to FIGS. 1 and 2, there is shown a reduced size GPS conical shaped microstrip antenna, designated generally by the reference numeral 20, which is adapted to receive GPS data from an external source such as satellite. GPS conical shaped microstrip antenna 20 is designed to operate at GPS L-Band, i.e. receive L-Band GPS carrier signals from a satellite or other source for generating GPS data and then transmitting the GPS generated data utilizing an L-Band GPS carrier signal/radio frequency (RF) signal. GPS conical shaped microstrip antenna 20 also a frequency bandwidth of twenty megahertz, a center frequency of 1.575 GHZ and provides for right hand circular polarization.

As depicted FIGS. 1 and 2, GPS conical shaped microstrip antenna 20 has four antenna elements 22, 24, 26 and 28 which approximate a square and have overall dimensions of 2 5/64" by 2 5/64". As shown in FIG. 1, antenna elements 22, 24, 26 and 28 are aligned with one another are equally spaced apart from one another. Each of the antenna elements 22, 24, 26 and 28 are mounted on a dielectric layer 30 which has an approximate thickness of 0.030 of an inch. Each antenna element 22, 24, 26 and 28 is fabricated from etched copper, includes a centrally located aperture 32 and includes four step-shaped tuning tabs 34, 36, 38 and 40 one of which is located at each side of the antenna element. The opening 32 in each antenna element 22, 24, 26 and 28 is approximately 0.024 of an inch and operates to reduce the size of or miniaturize microstrip antenna 20. The tuning tabs 34, 36, 38 and 40 for each antenna element 22, 24, 26 and 28 allow the designer to fine tune microstrip antenna 20 to its center frequency of 1.575 GHZ. The antenna elements 34,36, 38 and 40 receive GPS data transmitted via an L-Band GPS carrier signal/radio frequency (RF) signal from a satellite or the like.

Dielectric substrate 30, which with the antenna elements and feed network for antenna comprises the circuit board 31 of antenna 20, has an upper portion 42 above antenna elements 22, 24, 26 and 28, and a lower portion 44 below antenna elements 22, 24, 26 and 28. Each portion 42 and 44 has a pair of semicircular shaped notches 46 and 48 located at each end thereof which are used to position the board during fabrication of the circuit board.

Figure 6:
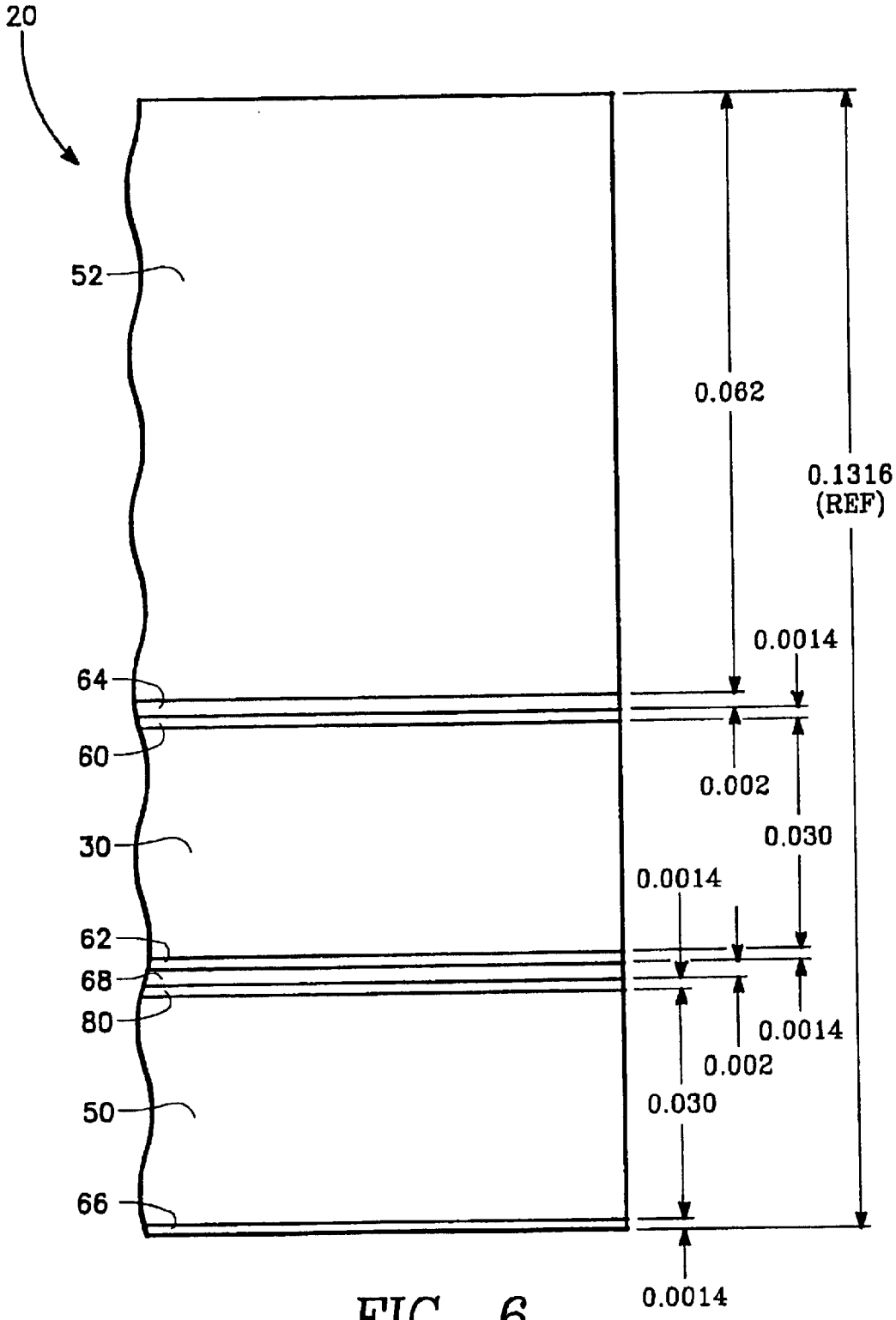
FIG. 6 is a side view of the dielectric layers, bonding films and copper elements of the microstrip antenna comprising the present invention.

Referring to FIGS. 1 and 2, when the dielectric layers 30, 50 and 52 for microstrip antenna 20 are assembled in the manner illustrated in FIG. 6, the upper portion 42 of dielectric layer 30 is removed from antenna 20 along line 54 and the lower portion 44 of dielectric layer 30 is removed from antenna 20 along line 56. When antenna 20 is fully assembled only the middle portion 58 of dielectric layer 30 remains.

As depicted in FIGS. 1 and 2, circuit board 31 also includes an etched copper cross hatch pattern 60 which is positioned around each of the antenna elements 22, 24, 26 and 28 and covers the remainder of the upper surface of dielectric layer 30. The etched copper cross hatch pattern 60 has 0.02 inch wide copper traces or strips 61 spaced apart by a 0.05 inch rectangular shaped opening 63 exposing the upper surface of dielectric layer 30. The 0.02 inch wide copper traces/strips 61 and the 0.05 inch openings 63 are best depicted in FIG. 2.

As shown in FIG. 2, a dielectric gap 65 having a width of 0.03 of an inch is provided in the periphery of antenna element 22 which separating the antenna element 22 from etched copper cross hatch pattern 60. Each of the other antenna elements 24, 26 and 28 has a gap around their periphery which separates the antenna element from copper cross hatch pattern 60.

Figure 3:
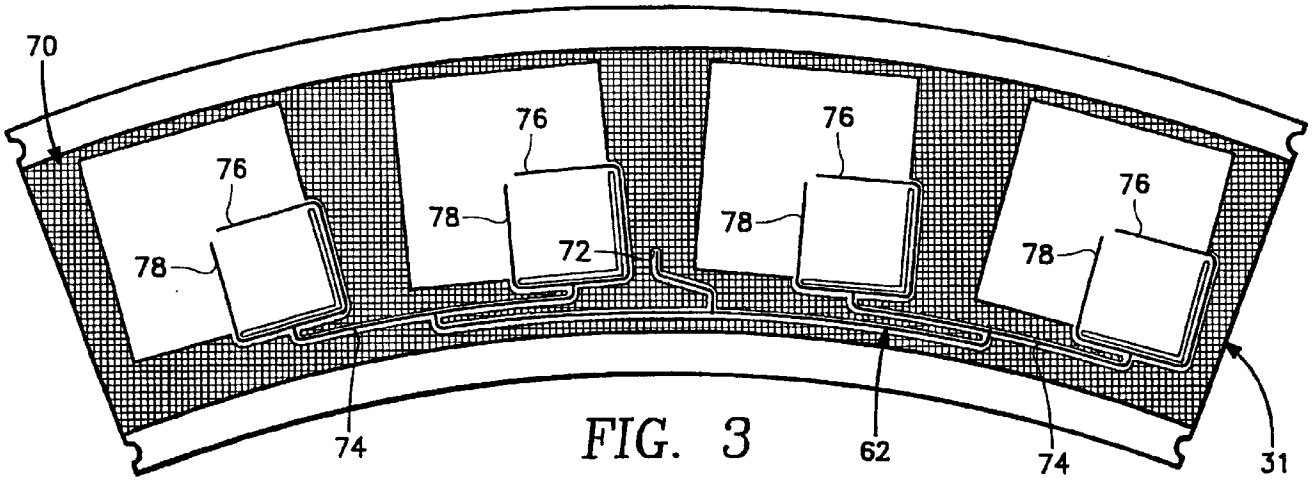
FIG. 3 illustrates the bottom copper layer of the circuit board of FIG. 1 which includes a feed network for the antenna elements of the microstrip antenna of FIG. 1.

At this time it should be noted that the exploded view of FIG. 2 illustrates in detail the copper cross hatch pattern 60 for the circuit board 31 of FIG. 1. As shown in FIG. 3, the bottom copper layer of circuit board 31 includes an etched copper cross hatch pattern 70 which identical to the copper cross hatch pattern 60 of the top copper layer of circuit board 31. As shown FIG. 4, the top copper layer of a ground board 51 includes an etched copper cross hatch pattern 80 which is identical to and in alignment with copper cross hatch pattern 70.

The copper cross hatch pattern 60 operates as a solid ground plane to the microwave frequencies of the RF carrier signals received by antenna 20 and also isolates the antenna elements 22, 24, 26 and 28 from the antenna feed network 62 which is mounted on the bottom surface of dielectric layer 30 below copper cross hatch pattern 60. Since the copper cross hatch pattern 60 exposes a substantial of dielectric substrate 30, there a high percentage of dielectric-to-dielectric bonding area available to secure dielectric layer 52 to dielectric layer 30.

Figure 5:
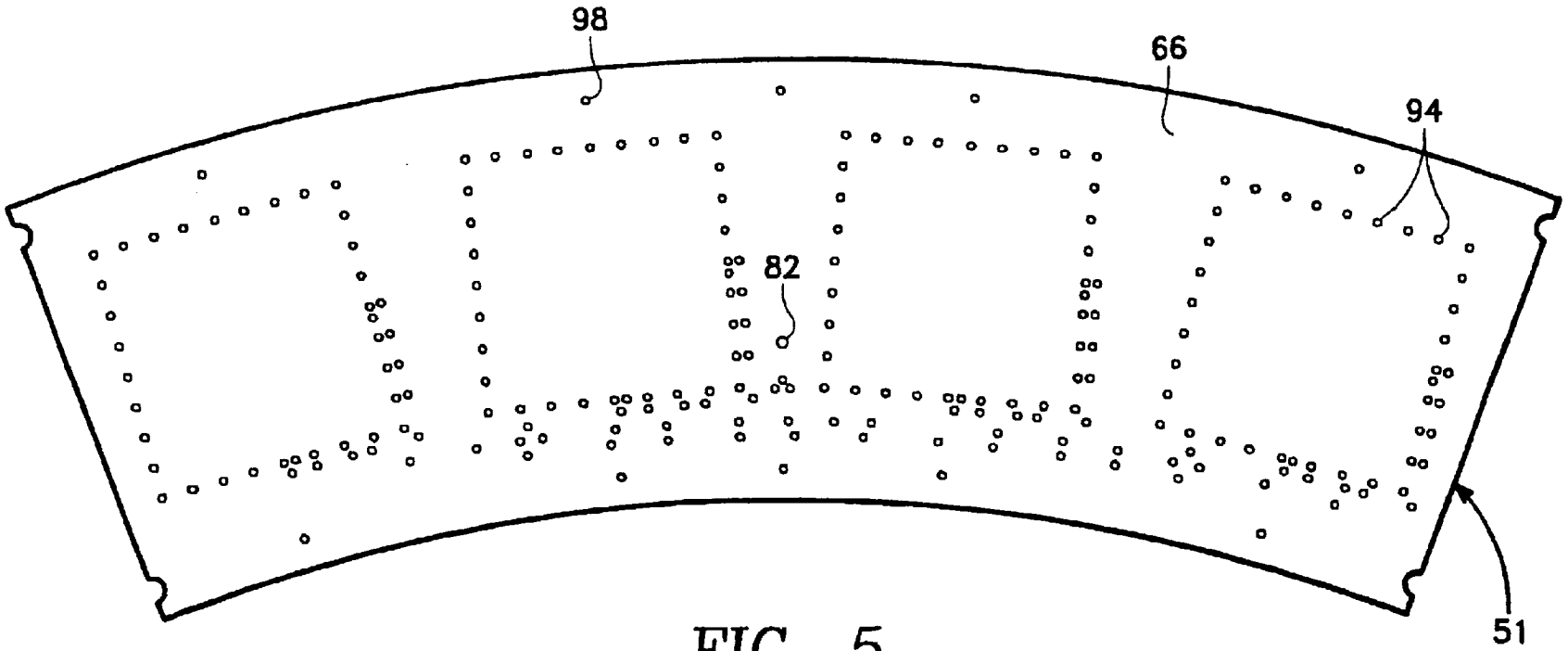
FIG. 5 illustrates the copper ground plane for the microstrip antenna comprising the present invention.

As shown in FIG. 6, the bonding film 64 between the bottom surface of dielectric layer 52 and the top surface of dielectric layer 30 secures dielectric layer 30 to dielectric layer 52. The bonding film has a thickness of 0.002 of an inch. The copper antenna elements 22, 24, 26 and 28 and ground plane cross hatch pattern 60, which are specefied as one ounce copper cladding, have a thickness of 0.0014 of an inch. Dielectric layer 52 has a thickness of 0.062 of an inch and is the cover board for GPS conical shaped microstrip antenna 20. Dielectric layer 50 is the ground board 51 for microstrip antenna 20, has a thickness of 0.030 of an inch and its bottom surface has a solid copper ground plane 66 affixed thereto. Copper ground plane 66, which is depicted in FIG. 5, has a thickness of 0.0014 of an inch. A 0.002 of an inch bonding film 68 secures dielectric layer 30 to dielectric layer 50.

At this time, it should be noted that the cover board, the circuit board and the ground board for the conical shaped microstrip antenna array comprising the present invention are fabricated using standard printed circuit board technology. The cover board which is dielectric layer 52 is fabricated from a laminate material RT/Duroid 5870 commercially available from Rogers Corporation of Rogers, Conn. The circuit board 31 and the ground board 51 are fabricated from a laminate material RT/Duroid 6002 also commercially available from Rogers Corporation.

Referring to FIGS. 1, 3 and 5, the feed network 62 matches a 50 ohm input impedance to the antenna feed network input 72 which is located near the center of microstrip antenna 20. The feed network input 72 is aligned with an opening 81 in dielectric layer 50 which allows for an electrical connector to pass through opening B1 connecting the antenna feed network 62 for antenna 20 to the weapons on board electronics systems.

The feed network 62 provide for equal distribution of RF signals to the four antenna elements 22, 24, 26 and 28 in both amplitude and phase. The feed network 62 includes a plurality of branch transmission lines 74 fabricated from etched copper which connect the feed network input 72 to the four antenna elements 22, 24, 26 and 28. Each branch transmission line 74 of feed network 62 includes a pair of probes 76 and 78 which are also etched copper transmission lines. The probes 74 and 76 are positioned perpendicular to one another underneath each antenna element 22, 24, 26 and 28 and terminate below the opening 32 for each antenna element 22, 24, 26 and 28. The feed line to probe 76 is substantially longer than the feed line to probe 74 to provide for two orthogonal modes for each antenna element at a ninety degree relative phase shift resulting in right hand circular polarization for the antenna elements 22, 24, 26 and 28 of antenna 20. EM coupling transmits RF signals from the antenna elements 22, 24, 26 and 28 to their associated probes 74 and 76 through the dielectric layer 30.

Figure 4:
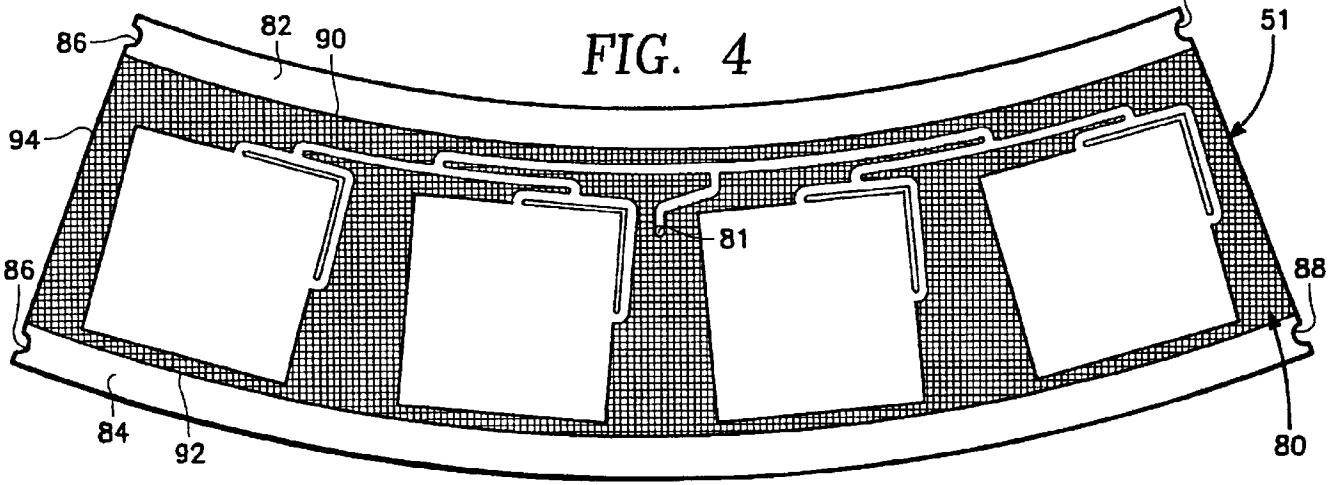
FIG. 4 illustrates the top copper layer of a ground board for the microstrip antenna comprising the present invention.

Referring to FIGS. 1, 3 and 4, the top layer of ground board 51 is a mirror image of the bottom layer of circuit board 31 except for feed network 62. When microstrip antenna 20 is fully assembled as shown in FIG. 6, cross hatch pattern 70 is in alignment with cross hatch pattern 80. This results in EM coupling of mirowave signals between the circuit board 31 and ground board 51 even though there is a 0.002 thick bonding film separating the two dielectric layers 30 and 50.

Dielectric substrate 50, which with the cross hatch pattern B0 and copper ground plane 66 comprises the ground board 51 of antenna 20, has an upper portion 82 above cross hatch pattern 80, and a lower portion 84 below cross hatch pattern 80. Each portion 82 and 84 has a pair of semicircular shaped notches 86 and 88 located at each end thereof which are used to position the board during fabrication of the ground board.

When the dielectric layers 30, 50 and 52 for microstrip antenna 20 are assembled in the manner illustrated in FIG. 6, the upper portion 82 of dielectric layer 50 is removed from antenna 20 along line 90 and the lower portion 84 of dielectric layer 50 is removed from antenna 20 along line 92. When antenna 20 is fully assembled only the middle portion 94 of dielectric layer 50 remains.

As shown in FIG. 5, the ground board 51 includes 205 copper plated through holes or vias 94 which are used to equalize potential on both sides of the ground board 51. There are also 10 additional holes 98 which are used for alignment purposes.

As shown in FIG. 2, the copper plated through holes 96 are positioned at the edge of dielectric gap 65 and also at the edge of the antenna feed network 62 for antenna 20. If too few vias 94 are included in ground board 51, the antenna feed network 62 for antenna 20 becomes coupled to the antenna elements 22, 24, 26 and 2B.

Referring to FIGS. 3 and 4, the layout of the bottom surface of circuit board 31 is identical to the layout of the upper surface of ground board 51 except for the antenna feed network 62 on the bottom surface of ground board 31. This allows microwave signals to EM couple between dielectric layers 30 and 52 even though there is bonding film 64 which separates dielectric layers 30 and 52. This unique feature of antenna 20 allows the vias on the circuit board 31 to couple to the vias on the ground board thereby electrically connecting the circuit board 31 to copper ground plane 66 on the bottom surface of ground board 51.

From the foregoing, it is readily apparent that the present invention comprises a new, unique and exceedingly useful GPS conical shaped microstrip antenna array for receiving GPS carrier signals which constitutes a considerable improvement over the known prior art. Many modifications and variations are possible in light of the above teachings. It is therefore to be understood that within the scope of the appended claims that the invention may be practiced otherwise than as specifically described.

What is claimed is:

1. A reduced size GPS conical shaped microstrip antenna array comprising:

(a) a first dielectric layer (b) a plurality of square shaped antenna elements mounted on an upper surface of said first dielectric layer, said antenna elements being aligned with one another and fabricated from copper, said antenna elements being adapted to receive an RF carrier signal containing GPS (Global Positioning System) data;

(d) a first copper cross hatch pattern mounted on the upper surface of said first dielectric layer around a periphery for each of said antenna elements wherein a gap forms between the periphery for each of said antenna elements and said copper cross hatch pattern;

(e) an antenna feed network mounted on a bottom surface of said first dielectric layer, said antenna feed network having a plurality of branch transmission lines electrically connected to each of said antenna elements, each of said branch transmission lines including a pair of probes positioned perpendicular to one another underneath one antenna element of said plurality of antenna elements, one of said pair of probes for each of said branch transmission lines having a length substantially greater than the other of said pair of probes for each of said branch transmission lines to provide for a ninety degree relative phase shift between RF signals transmitted through said pair of probes of each of said pair of branch transmission lines;

(f) a second copper cross hatch pattern mounted on the bottom surface of said first dielectric substrate in proximity to said antenna feed network;

(g) a second dielectric layer positioned below said first dielectric layer in alignment with said first dielectric layer;

(h) a third copper cross hatch pattern mounted on an upper surface of said second dielectric layer, said third copper cross hatch pattern being in alignment and substantially identical to said second cross hatch pattern; and (i) a solid copper ground plane affixed to a bottom surface of said first dielectric layer.

2. The reduced size GPS conical shaped microstrip antenna array of claim 1 further comprising a bonding film positioned between said first dielectric layer and said second dielectric layer, said bonding film securing the bottom surface of said first dielectric layer to the upper surface of said second dielectric layer.

3. The reduced size GPS conical shaped microstrip antenna array of claim 1 further comprising:

(a) a third dielectric layer positioned above said first dielectric layer in alignment with said first dielectric layer; and (b) a bonding film positioned between said first dielectric layer and said third dielectric layer, said bonding film securing the upper surface of said first dielectric layer to a bottom surface of said third dielectric layer.

4. The reduced size GPS conical shaped microstrip antenna array of claim 3 wherein said third dielectric layer is a cover for said reduced size GPS conical shaped microstrip antenna array.

5. The reduced size GPS conical shaped microstrip antenna array of claim 1 wherein said plurality of antenna elements comprises first, second, third and fourth antenna elements for receiving said RF carrier signal containing said GPS data, each of said first, second, third and fourth antenna elements having an opening located at the center thereof, the opening in each of said first, second, third and fourth antenna elements having a diameter of approximately 0.024 of an inch to reduce the size of said conical shaped microstrip antenna array.

6. The reduced size GPS conical shaped microstrip antenna array of claim 1 wherein each of said first, second and third copper cross hatch patterns comprises a plurality of 0.02 inch wide copper traces spaced apart by a 0.05 inch rectangular shaped opening.

7. The reduced size GPS conical shaped microstrip antenna array of claim 1 further comprising a plurality of copper plated through holes positioned within said first dielectric layer and a plurality of plated through holes positioned within said second dielectric layer, the copper plated through holes of said first dielectric layer aligning with the copper plated through holes of said second dielectric layer, the copper plated through holes of said first dielectric layer being EM coupled to the copper plated through holes of said second dielectric layer, wherein the copper plated through holes of said first dielectric layer and the copper plated through holes of said second dielectric layer prevent said antenna feed network from becoming electrically coupled to said antenna elements.

8. The reduced size GPS conical shaped microstrip antenna array of claim 7 wherein the copper plated through holes of said first dielectric layer and the copper plated through holes of said second dielectric layer each comprises two hundred five copper plated through holes.

9. The reduced size GPS conical shaped microstrip antenna array of claim 1 wherein said first dielectric layer and said second dielectric layer each have an approximate thickness of 0.030 of an inch, and said third dielectric layer has an approximate thickness of 0.062 of an inch.

10. A reduced size GPS conical shaped microstrip antenna array comprising:

(a) a first dielectric layer (b) a plurality of square shaped antenna elements mounted on an upper surface of said first dielectric layer, said antenna elements being aligned with one another and fabricated from copper, said antenna elements being adapted to receive an RF carrier signal containing GPS (Global Positioning System) data;

(d) a first copper cross hatch pattern mounted on the upper surface of said first dielectric layer around a periphery for each of said antenna elements wherein a gap forms between the periphery for each of said antenna elements and said copper cross hatch pattern;

(e) an antenna feed network mounted on a bottom surface of said first dielectric layer, said antenna feed network having a plurality of branch transmission lines electrically connected to each of said antenna elements, each of said branch transmission lines including a pair of probes positioned perpendicular to one another underneath one antenna element of said plurality of antenna elements, one of said pair of probes for each of said branch transmission lines having a length substantially greater than the other of said pair of probes for each of said branch transmission lines to provide for a ninety degree relative phase shift between RF signals transmitted through said pair of probes of each of said pair of branch transmission lines, said ninety degree relative phase shift providing for right hand circular polarization for plurality of antenna elements of said GPS conical shaped microstrip antenna array;

(f) a second copper cross hatch pattern mounted on the bottom surface of said first dielectric substrate in proximity to said antenna feed network;

(g) a second dielectric layer positioned below said first dielectric layer in alignment with said first dielectric layer;

(h) a third copper cross hatch pattern mounted on an upper surface of said second dielectric layer, said third copper cross hatch pattern being in alignment and substantially identical to said second cross hatch pattern; and (i) a solid copper ground plane affixed to a bottom surface of said first dielectric layer;

(j) a first bonding film positioned between said first dielectric layer and said second dielectric layer, said first bonding film securing the bottom surface of said first dielectric layer to the upper surface of said second dielectric layer;

(k) a third dielectric layer positioned above said first dielectric layer in alignment with said first dielectric layer; and (l) a second bonding film positioned between said first dielectric layer and said third dielectric layer, said second bonding film securing the upper surface of said first dielectric layer to a bottom surface of said third dielectric layer wherein said third dielectric layer is a cover for said reduced size GPS conical shaped microstrip antenna array.

11. The reduced size GPS conical shaped microstrip antenna array of claim 10 wherein said first dielectric layer and said second dielectric layer each have an approximate thickness of 0.030 of an inch, and said third dielectric layer has an approximate thickness of 0.062 of an inch.

12. The reduced size GPS conical shaped microstrip antenna array of claim 10 wherein said first bonding film and said second bonding film each have an approximate thickness of 0.002 of an inch.

13. The reduced size GPS conical shaped microstrip antenna array of claim 10 wherein said third dielectric layer is a cover for said reduced size GPS conical shaped microstrip antenna array.

14. The reduced size GPS conical shaped microstrip antenna array of claim 10 wherein said plurality of antenna elements comprises first, second, third and fourth antenna elements for receiving said RF carrier signal containing said GPS data, each of said first, second, third and fourth antenna elements having an opening located at the center thereof, the opening in each of said first, second, third and fourth antenna elements having a diameter of approximately 0.024 of an inch to reduce the size of said conical shaped microstrip antenna array.

15. The reduced size GPS conical shaped microstrip antenna array of claim 10 wherein each of said first, second and third copper cross hatch patterns comprises a plurality of 0.02 inch wide copper traces spaced apart by a 0.05 inch rectangular shaped opening.

16. The reduced size GPS conical shaped microstrip antenna array of claim 10 further comprising a plurality of copper plated through holes positioned within said first dielectric layer and a plurality of plated through holes positioned within said second dielectric layer, the copper plated through holes of said first dielectric layer aligning with the copper plated through holes of said second dielectric layer, the copper plated through holes of said first dielectric layer being EM coupled to the copper plated through holes of said second dielectric layer, wherein the copper plated through holes of said first dielectric layer and the copper plated through holes of said second dielectric layer prevent said antenna feed network from becoming electrically coupled to said antenna elements.

17. The reduced size GPS conical shaped microstrip antenna array of claim 16 wherein the copper plated through holes of said first dielectric layer and the copper plated through holes of said second dielectric layer each comprises two hundred five copper plated through holes.

18. A reduced size GPS conical shaped microstrip antenna array comprising:

(a) a first dielectric layer (b) a plurality of square shaped antenna elements mounted on an upper surface of said first dielectric layer, said antenna elements being aligned with one another and fabricated from copper, said antenna elements being adapted to receive an RF carrier signal containing GPS (Global Positioning System) data;

(d) a first copper cross hatch pattern mounted on the upper surface of said first dielectric layer around a periphery for each of said antenna elements wherein a gap forms between the periphery for each of said antenna elements and said copper cross hatch pattern;

(e) an antenna feed network mounted on a bottom surface of said first dielectric layer, said antenna feed network having a plurality of branch transmission lines electrically connected to each of said antenna elements, each of said branch transmission lines including a pair of probes positioned perpendicular to one another underneath one antenna element of said plurality of antenna elements, one of said pair of probes for each of said branch transmission lines having a length substantially greater than the other of said pair of probes for each of said branch transmission lines to provide for a ninety degree relative phase shift between RF signals transmitted through said pair of probes of each of said pair of branch transmission lines, said ninety degree relative phase shift providing for right hand circular polarization for plurality of antenna elements of said GPS conical shaped microstrip antenna array;

(f) a second copper cross hatch pattern mounted on the bottom surface of said first dielectric substrate in proximity to said antenna feed network;

(g) a second dielectric layer positioned below said first dielectric layer in alignment with said first dielectric layer;

(h) a third copper cross hatch pattern mounted on an upper surface of said second dielectric layer, said third copper cross hatch pattern being in alignment and substantially identical to said second cross hatch pattern; and (i) a solid copper ground plane affixed to a bottom surface of said first dielectric layer;

(j) a first bonding film positioned between said first dielectric layer and said second dielectric layer, said first bonding film securing the bottom surface of said first dielectric layer to the upper surface of said second dielectric layer;

(k) a third dielectric layer positioned above said first dielectric layer in alignment with said first dielectric layer;

(l) a second bonding film positioned between said first dielectric layer and said third dielectric layer, said second bonding film securing the upper surface of said first dielectric layer to a bottom surface of said third dielectric layer wherein said third dielectric layer is a cover for said reduced size GPS conical shaped microstrip antenna array;

(m) said first dielectric layer and said second dielectric layer each have an approximate thickness of 0.030 of an inch, said third dielectric layer has an approximate thickness of 0.062 of an inch, and said first bonding film and said second bonding film each have an approximate thickness of 0.002 of an inch; and (n) a plurality of copper plated through holes positioned within said first dielectric layer and a plurality of plated through holes positioned within said second dielectric layer, the copper plated through holes of said first dielectric layer aligning with the copper plated through holes of said second dielectric layer, the copper plated through holes of said first dielectric layer being EM coupled to the copper plated through holes of said second dielectric layer, wherein the copper plated through holes of said first dielectric layer and the copper plated through holes of said second dielectric layer prevent said antenna feed network from becoming electrically coupled to said antenna elements.

19. The reduced size GPS conical shaped microstrip antenna array of claim 18 wherein said plurality of antenna elements comprises first, second, third and fourth antenna elements for receiving said RF carrier signal containing said GPS data, each of said first, second, third and fourth antenna elements having an opening located at the center thereof, the opening in each of said first, second, third and fourth antenna elements having a diameter of approximately 0.024 of an inch to reduce the size of said conical shaped microstrip antenna array.

20. The reduced size GPS conical shaped microstrip antenna array of claim 18 wherein each of said first, second and third copper cross hatch patterns comprises a plurality of 0.02 inch wide copper traces spaced apart by a 0.05 inch rectangular shaped opening.

21. The reduced size GPS conical shaped microstrip antenna array of claim 18 wherein the copper plated through holes of said first dielectric layer and the copper plated through holes of said second dielectric layer each comprises two hundred five copper plated through holes.

* * * * *